US010996579B2

(12) United States Patent
Sawamoto et al.

(10) Patent No.: US 10,996,579 B2
(45) **Date of Patent: *May 4, 2021**

(54) MAGNETIC CORE MATERIAL FOR ELECTROPHOTOGRAPHIC DEVELOPER, CARRIER FOR ELECTROPHOTOGRAPHIC DEVELOPER, AND DEVELOPER

(71) Applicant: POWDERTECH CO., LTD., Kawasaki (JP)

(72) Inventors: Hiroki Sawamoto, Kashiwa (JP); Tetsuya Uemura, Kashiwa (JP)

(73) Assignee: POWDERTECH CO., LTD., Kashiwa (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/483,718

(22) PCT Filed: Jan. 15, 2018

(86) PCT No.: PCT/JP2018/000877

§ 371 (c)(1),
(2) Date: Aug. 5, 2019

(87) PCT Pub. No.: WO2018/147002

PCT Pub. Date: Aug. 16, 2018

(65) Prior Publication Data

US 2020/0026211 A1 Jan. 23, 2020

(30) Foreign Application Priority Data

Feb. 10, 2017 (JP) ..... JP2017-023597

(51) Int. Cl.
*G03G 9/00* (2006.01)
*G03G 9/107* (2006.01)
(Continued)

(52) U.S. Cl.
CPC ..... *G03G 9/107* (2013.01); *G03G 9/0837* (2013.01); *G03G 9/113* (2013.01); *H01F 1/11* (2013.01)

(58) Field of Classification Search
CPC ..... G03G 9/107; G03G 9/1131
(Continued)

(56) References Cited

U.S. PATENT DOCUMENTS 5,652,060 A 6/1997 Uchida et al.
10,754,271 B2 * 8/2020 Sawamoto ..... G03G 9/107
(Continued)

FOREIGN PATENT DOCUMENTS

JP H09-059025 A 3/1997
JP 2009-234839 A 10/2009
(Continued)

OTHER PUBLICATIONS

Office Action for related JP App. No. 2017-023597 dated Aug. 18, 2020. English translation provided; 12 pages.
(Continued)

*Primary Examiner* — Mark A Chapman
(74) *Attorney, Agent, or Firm* — Procopio, Cory, Hargreaves & Savitch LLP

(57) ABSTRACT

A magnetic core material for electrophotographic developer, satisfying a value of Expression (1): a+b×10+c+d+e+f, being from 200 to 1,400, when an amount of fluorine ion is denoted by a (ppm), an amount of chlorine ion is denoted by b (ppm), an amount of bromide ion is denoted by c (ppm), an amount of nitrite ion is denoted by d (ppm), an amount of nitrate ion is denoted by e (ppm), and an amount of sulfate ion is denoted by f (ppm), which are measured by combustion ion chromatography; and having a pore volume of from 30 to 100 $mm^3/g$.

7 Claims, 1 Drawing Sheet

(51) Int. Cl.
*G03G 9/083* (2006.01)
*G03G 9/113* (2006.01)
*H01F 1/11* (2006.01)

(58) Field of Classification Search
USPC ..... 430/111.3, 111.31
See application file for complete search history.

(56) References Cited

U.S. PATENT DOCUMENTS

| | | | |
|---|---|---|---|
| 2009/0246526 | A1 | 10/2009 | Sugiura et al. |
| 2009/0263739 | A1 | 10/2009 | Sugiura et al. |
| 2010/0055601 | A1 | 3/2010 | Sugiura et al. |
| 2011/0212399 | A1 | 9/2011 | Suwa et al. |
| 2014/0287355 | A1 | 9/2014 | Sawamoto et al. |

FOREIGN PATENT DOCUMENTS

| | | | |
|---|---|---|---|
| JP | 2010-055014 | A | 3/2010 |
| JP | 2011-180296 | A | 9/2011 |
| JP | 2014-197040 | A | 10/2014 |
| JP | 2016-025288 | A | 2/2016 |
| JP | 2016-224237 | A | 12/2016 |

OTHER PUBLICATIONS

International Search Report and Written Opinion for related International Application No. PCT/JP2018/000877, dated Apr. 17, 2018; English translation of ISR provided; 10 pages.
EESR from the EPO in the counterpart EP Patent Application No. 18751417.9, dated Oct. 21, 2020, Total 7 pages.

* cited by examiner

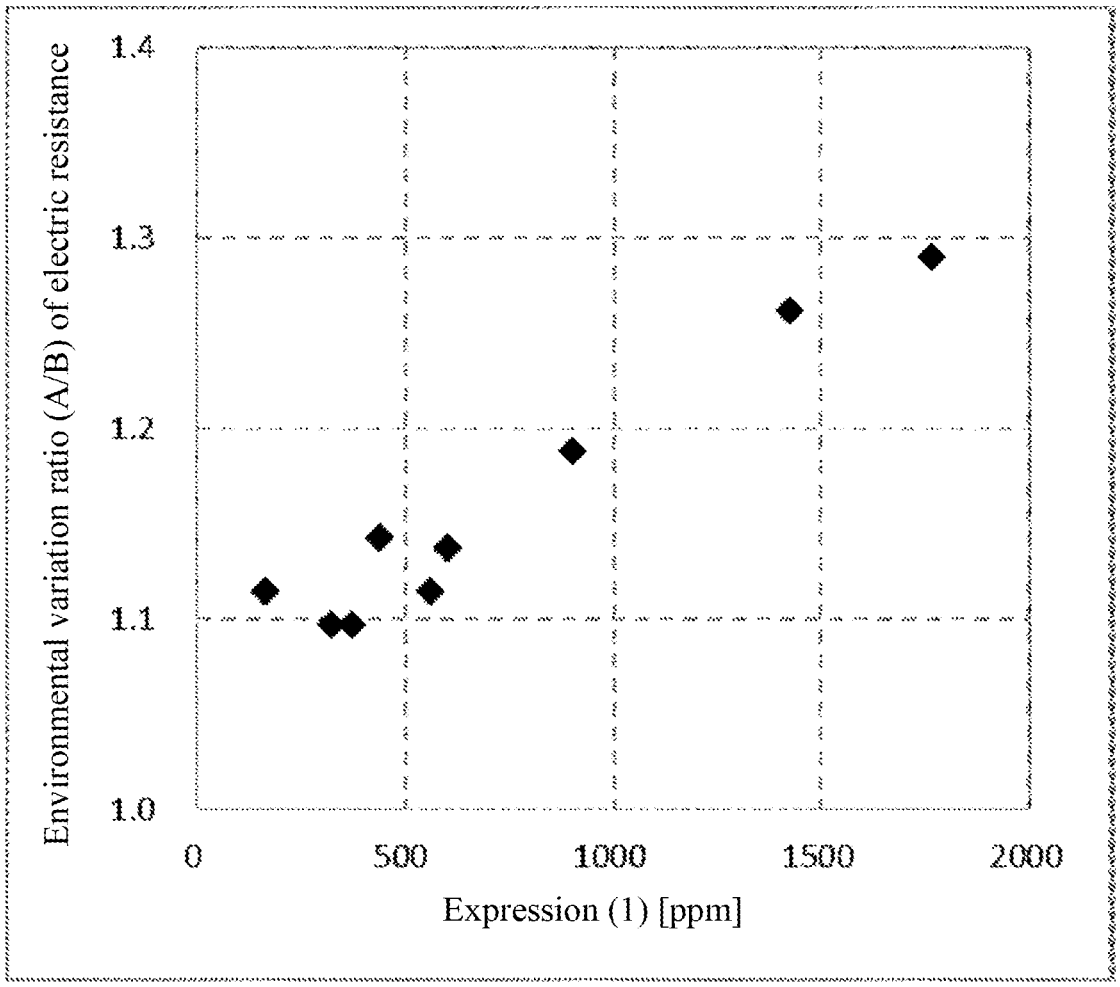
Environmental variation ratio (A/B) of electric resistance
1.4
1.3
1.2
1.1
1.0
0
500
1000
1500
2000
Expression (1) [ppm]

MAGNETIC CORE MATERIAL FOR ELECTROPHOTOGRAPHIC DEVELOPER, CARRIER FOR ELECTROPHOTOGRAPHIC DEVELOPER, AND DEVELOPER

CROSS-REFERENCE TO RELATED APPLICATIONS

This application is a U.S. National Stage entry of PCT Application No: PCT/JP2018/000877 filed on Jan. 15, 2018, which claims priority to Japanese Patent Application No. 2017-023597, filed Feb. 10, 2017, the contents of which are incorporated herein by reference.

TECHNICAL FIELD

The present invention relates to a magnetic core material for electrophotographic developer, a carrier for electrophotographic developer, and a developer.

BACKGROUND ART

The electrophotographic development method is a method in which toner particles in a developer are made to adhere to electrostatic latent images formed on a photoreceptor to develop the images. The developer used in this method is classified into a two-component developer composed of a toner particle and a carrier particle, and a one-component developer using only a toner particle.

As a development method using the two-component developer composed of a toner particle and a carrier particle among those developers, a cascade method and the like were formerly employed, but a magnetic brush method using a magnet roll is now in the mainstream. In the two-component developer, a carrier particle is a carrier substance which is agitated with a toner particle in a development box filled with the developer to impart a desired charge to the toner particle, and further transports the charged toner particle to a surface of a photoreceptor to form toner images on the photoreceptor. The carrier particle remaining on a development roll to hold a magnet is again returned from the development roll to the development box, mixed and agitated with a fresh toner particle, and used repeatedly in a certain period.

In the two-component developer, unlike a one-component developer, the carrier particle has functions of being mixed and agitated with a toner particle to charge the toner particle and transporting the toner particle to a surface of a photoreceptor, and it has good controllability on designing a developer. Therefore, the two-component developer is suitable for using in a full-color development apparatus requiring a high image quality, a high-speed printing apparatus requiring reliability for maintaining image and durability, and the like. In the two-component developer thus used, it is needed that image characteristics such as image density, fogging, white spots, gradation, and resolving power exhibit predetermined values from the initial stage, and additionally these characteristics do not vary and are stably maintained during the durable printing period (i.e., a long period of time of use). In order to stably maintain these characteristics, characteristics of a carrier particle contained in the two-component developer need to be stable. As a carrier particle forming the two-component developer, various carrier such as an iron powder carrier, a ferrite carrier, a resin-coated ferrite carrier, and a magnetic powder-dispersed resin carrier have conventionally been used.

Recently, networking of offices progresses, and the time changes from a single-function copying machine to a multifunctional machine. In addition, a service system also shifts from a system where a service person who contracts to carry out regular maintenance and to replace a developer or the like to the time of a maintenance-free system. The demand for further extending the life of the developer from the market is increasing more and more.

Under such circumstances, resin-filled ferrite carriers in which resin is filled in voids of a ferrite carrier core material using porous ferrite particles have been proposed for the intention of reducing the weight of the carrier particles and for the purpose of extending the life of the developer. For example, Patent Literature 1 (JP-A-2014-197040) proposes a resin-filled ferrite carrier core material for electrophotographic developer including porous ferrite particles having an average compression breaking strength of 100 mN or more and a compression breaking strength variation coefficient of 50% or less; and a resin-filled ferrite carrier for electrophotographic developer in which a resin is filled in voids of the ferrite carrier core material. It is described that according to this ferrite carrier, since the carrier particles can expect reduction in weight because of a low specific gravity and have high strength, effects such as excellent durability and achieving long life can be achieved.

On the other hand, it has been also known that trace amounts of elements in the carrier core material deteriorate carrier characteristics. For example, Patent Literature 2 (JP-A-2010-55014) proposes a resin-filled carrier for electrophotographic developer, which is obtained by filling resin in voids of a porous ferrite core material, in which a Cl concentration of the porous ferrite core material measured by an elution method is from 10 to 280 ppm, and the resin contains an amine compound. It is described that according to this carrier, since the Cl concentration of the porous ferrite core material is reduced within a certain range and the amine compound is contained in the filling resin, a charge amount as desired can be obtained and a small change in charge amount due to environmental changes can be achieved. Furthermore, although not related to porous ferrite, Patent Literature 3 (JP-A-2016-25288) proposes a ferrite magnetic material which includes main components containing Fe and additive elements such as Mn and has an average particle size of from 1 to 100 μm, in which the total amount of impurities excluding Fe, additive elements, and oxygen in the ferrite magnetic material is 0.5 mass % or less, and the impurities include at least two or more of Si, Al, Cr, Cu, P, Cl, Ni, Mo, Zn, Ti, sulfur, Ca, Mn, and Sr. It is described that a magnetic carrier using, as a magnetic carrier core material for electrophotographic developer, the ferrite magnetic material in which the influence of the impurities in the raw material is suppressed, has a high magnetic force and exhibits an effect of suppressing carrier scattering.

CITATION LIST

Patent Literature

Patent Literature 1: JP-A-2014-197040
Patent Literature 2: JP-A-2010-55014
Patent Literature 3: JP-A-2016-25288

SUMMARY OF INVENTION

As such, on the one hand, attempts to improve the carrier characteristics by suppressing the contents of trace elements contained in the carrier core material have been known; but on the other hand, further improvement of the carrier characteristics has been desired in response to the demands for high image quality and high-speed printing. In this respect, the porous ferrite core material and the resin-filled carrier containing the same have a unique low specific gravity and thus, can reduce the mechanical stresses such as collision, impact and friction between particles and stress generated between particles in the developing machine, and can reduce breakage cracks of the carrier and toner spent even during long-term use, whereby long-term stability during durable printing can be achieved. However, it is hard to say that those attempts have sufficiently met the high requirements of recent years. In particular, the electric resistance is a factor affecting image characteristics such as carrier scattering, white spots, image density, fogging, and toner scattering, and properties of the carrier core material also affect the carrier. Therefore, the electric resistance characteristics of the carrier core material are important in obtaining a satisfactory image. Furthermore, for the purpose of suppressing image defects caused by changes in use environment, lowering the environmental dependency of the core material resistance is desired.

The present inventors have this time found that in the magnetic core material for electrophotographic developer, the contents of specific anion components measured by combustion ion chromatography and the pore volume are important in consideration of obtaining excellent electric resistance characteristics and strength. Specifically, they have found that by controlling the contents of specific anion components and the pore volume as appropriate, change of the electric resistance caused by environmental variation is reduced with low specific gravity and strength is excellent, and as a result, a satisfactory image can stably be obtained when being used for a carrier or a developer.

Accordingly, an object of the present invention is to provide a magnetic core material for electrophotographic developer, which has a small change of electric resistance caused by environmental variation and excellent strength while being low in specific gravity, and with which a satisfactory image can stably be obtained when being used for a carrier or a developer. Another object of the present invention is to provide a carrier for electrophotographic developer and the developer including such a magnetic core material.

According to an aspect of the present invention, there is provided a magnetic core material for electrophotographic developer, satisfying a value of Expression (1): $a+b\times10+c+d+e+f$, being from 200 to 1,400, when an amount of fluorine ion is denoted by a (ppm), an amount of chlorine ion is denoted by b (ppm), an amount of bromide ion is denoted by c (ppm), an amount of nitrite ion is denoted by d (ppm), an amount of nitrate ion is denoted by e (ppm), and an amount of sulfate ion is denoted by f (ppm), which are measured by combustion ion chromatography, and having a pore volume of from 30 to 100 $mm^3/g$.

According to another aspect of the present invention, there is provided a carrier for electrophotographic developer including the magnetic core material for electrophotographic developer and a coating layer made of a resin provided on a surface of the magnetic core material.

According to another aspect of the present invention, there is provided the carrier for electrophotographic developer, further including a resin filled in pores of the magnetic core material.

According to still another aspect of the present invention, there is provided a developer including the carrier and a toner.

BRIEF DESCRIPTION OF DRAWINGS

[FIG. 1] It shows a relationship between a value of Expression (1) and an environmental variation ratio of electric resistance (A/B) in a magnetic core material.

DESCRIPTION OF EMBODIMENTS

In the specification, a numerical value range represented by using "to" means a range including numerical values given before and after "to" as a lower limit value and an upper limit value, respectively.

The magnetic core material for electrophotographic developer is a particle capable of being used as a carrier core material, and the carrier core material is coated with a resin to form a magnetic carrier for electrophotographic developer. An electrophotographic developer is formed by containing the magnetic carrier for electrophotographic developer and a toner.

Magnetic Core Material for Electrophotographic Developer

The magnetic core material for a developer for electrophotography (hereinafter, also referred to as "magnetic core material" or "carrier core material" in some cases) of the present invention has a feature that the contents of specific anion components measured by combustion ion chromatography is controlled within a specific range. Specifically, when an amount of fluorine ion is denoted by a (ppm), an amount of chlorine ion is denoted by b (ppm), an amount of bromide ion is denoted by c (ppm), an amount of nitrite ion is denoted by d (ppm), an amount of nitrate ion is denoted by e (ppm), and an amount of sulfate ion is denoted by f (ppm), in the magnetic core material, the value of Expression (1): $a+b\times10+c+d+e+f$ is from 200 to 1,400. According to such a magnetic core material, a carrier having excellent electric resistance characteristics and strength can be obtained. In the case where the value of Expression (1) is more than 1,400, environmental dependency of the electric resistance becomes large. This is because the more the contents of the specific anion components (hereinafter, also simply referred to as "anion components" in some cases) are, the larger the change in electric resistance of the magnetic core material is when undergoing a change of environment. The reason for this is considered that because the anion components easily absorb environmental moisture, the moisture content of the magnetic core material increases particularly under a high-temperature and high-humidity condition, to enhance an ion conductive property, resulting in lowering of the resistance of the core material. On the other hand, in the case where the value of Expression (1) is less than 200, the fluctuation of the compression breaking strength becomes large and the durability of the carrier becomes inferior. It is considered that this is probably because if the anion components in the magnetic core material is too small in amount, the effect of inhibiting sintering becomes too small, and the crystal growth rate becomes excessively large during firing step at the time of producing the magnetic core material. It is presumed that if the crystal growth rate is excessively high, the degree of sintering varies among the particles as compared with the case where the crystal growth rate is appropriate even if the firing conditions are adjusted, resulting in a large proportion of particles having low strength. In the case where particles of low strength are used as carriers, breakage cracks due to agitation stress during durable printing period or mechanical stress such as collision of particles with each other, impact, friction, or stress occurred between particles in a development box occur, and image defects are caused by a change in electrical characteristics. In addition, in order to produce a magnetic core material having a value of Expression (1) being less than 200, it is necessary to use a raw material having high quality (low contents of anion components) or to pass through a step for increasing the quality and thus, there is a problem of poor productivity. The value of Expression (1) is preferably from 250 to 1,200, and particularly preferably from 300 to 1,000. In addition, the contents of the anion components in the magnetic core material preferably satisfy the value of Expression (2): b×10+f being from 200 to 1,400, more preferably 250 to 1,200, and even more preferably 300 to 1,000.

The content a of fluorine ion in the magnetic core material is preferably from 0.1 to 5.0 ppm, more preferably 0.5 to 3.0 ppm, and even more preferably 0.5 to 2.0 ppm. The contents (ppm) of the anion components are on a weight basis.

The combustion ion chromatography is a technique in which a sample is burned in oxygen-containing gas flow, the gas generated is absorbed in an adsorption solution and then, a halogen or a sulfate ion adsorbed in the adsorption solution is quantitatively analyzed by an ion chromatography method. The technique makes it possible to easily analyze a halogen or sulfur component in ppm order which has been conventionally difficult. The contents of anion components are values measured by the combustion ion chromatography, but the detection of an anion component does not mean that it is limited to that contained in the form of an anion in the magnetic core material. For example, even when a sulfate ion is detected by a combustion ion chromatography method, it does not mean to be limited to that the magnetic core material contains a sulfur component in the form of a sulfate ion, and the sulfur component may be contained in the form of elemental sulfur, a metal sulfide, a sulfate ion, other sulfides or the like.

The values of the contents of anion components described in the specification are values measured by the combustion ion chromatography method under the conditions described in Examples described later.

In addition, the contents of cation components in the magnetic core material can be measured by an emission spectroscopic analysis. The contents of cation components described in the present specification are values measured by ICP emission spectroscopy (high frequency inductively coupled plasma emission spectroscopy) under the conditions described in Examples described later.

In addition, the magnetic core material of the present invention has a pore volume of from 30 to 100 $mm^3/g$. In the case where the pore volume is less than 30 $mm^3/g$, weight reduction cannot be achieved. On the other hand, in the case of more than 100 $mm^3/g$, the strength of the carrier cannot be maintained. The pore volume is preferably from 35 to 85 $m^3/g$, and more preferably from 40 to 70 $mm^3/g$.

The pore volume value described in the present specification is a value measured and calculated by using a mercury porosimeter under the conditions described in Examples described later.

As to the magnetic core material, as long as it functions as a carrier core material, the composition thereof is not particularly limited and a conventionally known composition may be used. The magnetic core material typically has a ferrite composition (ferrite particle) and preferably has a ferrite composition containing Fe, Mn, Mg, and Sr. On the other hand, in consideration of the recent trend of the environmental load reduction including the waste regulation, it is desirable that heavy metals such as Cu, Zn and Ni are not contained in a content exceeding inevitable impurities (associated impurities) range. The contents of these heavy metals are typically 1% or less.

Particularly preferably, the magnetic core material is one having a composition represented by the formula: $(MnO)_x(MgO)_y(Fe_2O_3)_z$ in which MnO and MgO are partially substituted with SrO. Here, x=35 to 45 mol %, y=5 to 15 mol %, z=40 to 60 mol %, and x+y+z=100 mol %. By setting x to 35 mol % or more and y to 15 mol % or less, magnetization of ferrite is increased and carrier scattering is further suppressed. On the other hand, by setting x to 45 mol % or less and y to 5 mol % or more, a magnetic core having a higher charge amount can be obtained.

This magnetic core material contains SrO in its composition. Inclusion of SrO suppresses generation of low magnetization particles. In addition, together with $Fe_2O_3$, SrO forms a magnetoplumbite ferrite in a form of $(SrO)\cdot 6(Fe_2O_3)$ or a precursor of a strontium ferrite (hereinafter referred to as an Sr—Fe compound), which is a cubical crystal as represented by $Sr_aFe_bO_c$ (here, $a\geq 2$, $a+b\leq c\leq a+1.5b$) and has a perovskite crystal structure, and forms a complex oxide solid-solved in $(MnO)_x(MgO)_y(Fe_2O_3)_x$ in a spinel structure. This complex oxide of iron and strontium has an effect of improving the charge imparting ability of the magnetic core material in mainly cooperation with magnesium ferrite which is a component containing MgO. In particular, the Sr—Fe compound has a crystal structure similar to that of $SrTiO_3$, which has a high dielectric constant, and thus contributes to high charging capacity of the magnetic core material. The substitution amount of SrO is preferably from 0.1 to 2.5 mol %, more preferably 0.1 to 2.0 mol %, and even more preferably 0.3 to 1.5 mol %, based on the total amount of $(MnO)_x(MgO)_y(Fe_2O_3)_z$. By setting the substitution amount of SrO to 0.1 mol % or more, the effect of containing SrO is further exerted. By setting to 2.5 mol % or less, excessive increases in remanent magnetization and coercive force are suppressed, and as a result, the carrier fluidity becomes better.

The volume average particle diameter ($D_{50}$) of the magnetic core material is preferably from 20 to 50 μm. By setting the volume average particle diameter to 20 μm or more, carrier scattering is sufficiently suppressed. On the other hand, by setting to 50 μm or less, the image quality deterioration due to the decrease in charge imparting ability can further be suppressed. The volume average particle size is more preferably from 25 to 50 μm, and more preferably from 25 to 45 μm.

The apparent density (AD) of the magnetic core material is preferably from 1.5 to 2.1 $g/cm^3$. By setting the apparent density to 1.5 $g/cm^3$ or more, excessive weight reduction of the carrier is suppressed and the charge imparting ability is further improved. On the other hand, by setting to 2.1 $g/cm^3$ or less, the effect of reducing the carrier weight can be made sufficient and the durability is further improved. The apparent density is more preferably from 1.7 to 2.1 $g/cm^3$, and even more preferably from 1.7 to 2.0 $g/cm^3$.

The BET specific surface area of the magnetic core material is preferably from 0.25 to 0.60 $m^2/g$. By setting the BET specific surface area to 0.25 $m^2/g$ or more, a decrease in effective charging area is suppressed and the charge imparting ability is further improved. On the other hand, by setting to 0.60 $m^2/g$ or less, a decrease in compression breaking strength is suppressed. The BET specific surface area is preferably from 0.25 to 0.50 $m^2/g$, and more preferably from 0.30 to 0.50 $m^2/g$.

In addition, the environmental variation ratio (A/B) of the electric resistance of the magnetic core material is preferably 1.25 or less, more preferably 1.23 or less, and even more preferably 1.20 or less. Here, the environmental variation ratio (A/B) of the electric resistance is an index representing the change of electric resistance caused by environmental variation, and as shown in the following formula, is calculated as a ratio of the logarithmic value (Log $R_{L/L}$) of electric resistance $R_{L/L}$ (unit: Ω) under the low temperature/low humidity (L/L) environment to the logarithmic value (Log $R_{H/H}$) of electric resistance $R_{H/H}$ (unit: Ω) under the high temperature/high humidity (H/H) environment.

$$A/B = \text{Log } R_{L/L} / \text{Log } R_{H/H} \quad \text{[Math. 1]}$$

By setting the environmental variation ratio (A/B) of the electric resistance to 1.25 or less, environmental dependence of the resistance of the core material can be reduced, and suppression of image defects caused by a change in the use environment can be sufficiently achieved. Here, the H/H environment refers to an environment at a temperature of from 30 to 35° C. and a relative humidity of from 80 to 85%, and the L/L environment refers to an environment at a temperature of from 10 to 15° C. and a relative humidity of from 10 to 15%.

The average of compression breaking strength (average compression breaking strength: $CS_{ave}$) of the magnetic core material is preferably 100 mN or more, more preferably 120 mN or more, and even more preferably 150 mN or more. The average of compression breaking strength refers to the average of compression breaking strengths of the individual particles in a particle aggregate of the magnetic core material. By setting the average compression breaking strength to 100 mN or more, the strength as a carrier is increased, and thus the durability is further improved. Although the upper limit of the average compression breaking strength is not particularly limited, it is typically 450 mN or less.

The variation coefficient of compression breaking strength (compression breaking strength variation coefficient: $CS_{var}$) of the magnetic core material is preferably 40% or less, more preferably 37% or less, and even more preferably 34% or less. The compression breaking strength variation coefficient is an index of the variation of the compression breaking strength of individual particles in a particle aggregate of the magnetic core material, and can be obtained by a method described later. By setting the variation coefficient of the compression breaking strength to 40% or less, the proportion occupied by particles with low strength can be lowered, and the strength as a carrier can be increased. Although the lower limit of the compression breaking strength variation coefficient is not particularly limited, it is typically 5% or more.

The average compression breaking strength ($CS_{ave}$) and the compression breaking strength variation coefficient ($CS_{var}$) of the magnetic core material can be measured, for example, as follows. That is, an ultra-small indentation hardness tester (ENT-1100a, produced by Elionix Co., Ltd.) is used for measuring the compression breaking strength. A sample dispersed on a glass plate is set in the tester and subjected to measurement under an environment of 25° C. For the test, a flat indenter with a diameter of 50 μmϕ is used and loaded up to 490 mN at a load speed of 49 mN/s. As a particle to be used for measurement, a particle which is singly present on the measurement screen (lateral 130 μm×length 100 μm) of the ultra-micro indentation hardness tester, has a spherical shape, and of which an average value of a major axis and a minor axis when measured by software attached to ENT-1100a is volume average particle diameter ±2 μm is selected. It is presumed that the particle has broken down when the slope of the load-displacement curve approaches 0, and the load at the inflection point is taken as the compression breaking strength. The compression breaking strengths of 100 particles are measured and the compression breaking strengths of 80 pieces excluding those of 10 particles from each of the maximum value and the minimum value are employed as data to obtain the average compression breaking strength ($CS_{ave}$). Furthermore, the compression breaking strength variation coefficient ($CS_{var}$) is calculated from the following formula by calculating the standard deviation ($CS_{sd}$) for the 80 particles above.

$$CS_{var}(\%) = (CS_{sd}/CS_{ave}) \times 100 \quad \text{[Math. 2]}$$

As described above, by controlling the anion amounts measured by combustion ion chromatography and the pore volume, the magnetic core material (carrier core material) for a developer for electrophotography of the present invention can provide a carrier which has a small change of the electric resistance caused by environmental differences while being low in specific gravity and has high compression breaking strength with suppressed fluctuation thereof, and with which a satisfactory image free of defects can be obtained. To the present inventor's knowledge, techniques for controlling the anion amounts and the pore volume have not heretofore been known. For example, Patent Literature 2 specifies the Cl concentration measured by an elution method, but there is no mention about the effect of anion components other than Cl. In addition, the elution method is a technique for measuring the concentration of a component present on the particle surface, and the measurement principle thereof is completely different from that of ion chromatography. Furthermore, although Patent Literature 3 specifies the total amount of impurities in the ferrite magnetic material, the document focuses on merely minimizing the total amount of impurities such as Si or Al as much as possible and does not teach controlling the anion amounts to fall within a specific range, and there is no disclosure related to the pore volume at all.

Carrier for Electrophotographic Developer

The carrier for electrophotographic developer (also simply referred to as carrier in some cases) of the present invention includes the magnetic core material (carrier core material) and a coating layer formed of a resin and provided on a surface of the magnetic core material. Carrier characteristics may be affected by materials present on the carrier surface and properties thereof. Therefore, by surface-coating with an appropriate resin, desired carrier characteristics can precisely be imparted.

The coating resin is not particularly limited. Examples thereof include a fluorine resin, an acrylic resin, an epoxy resin, a polyamide resin, a polyamide imide resin, a polyester resin, an unsaturated polyester resin, a urea resin, a melamine resin, an alkyd resin, a phenol resin, a fluoroacrylic resin, an acryl-styrene resin, a silicone resin, and a modified silicone resin modified with a resin such as an acrylic resin, a polyester resin, an epoxy resin, a polyamide resin, a polyamide imide resin, an alkyd resin, a urethane resin, or a fluorine resin, and the like. In consideration of elimination of the resin due to the mechanical stress during usage, a thermosetting resin is preferably used. Specific examples of the thermosetting resin includes an epoxy resin, a phenol resin, a silicone resin, an unsaturated polyester resin, a urea resin, a melamine resin, an alkyd resin, resins containing them, and the like. The coating amount of the resin is preferably from 0.5 to 5.0 parts by weight with respect to 100 parts by weight of the magnetic core material.

Furthermore, a conductive agent or a charge control agent may be incorporated into the coating resin. Examples of the conductive agent include conductive carbon, an oxide such as titanium oxide or tin oxide, various types of organic conductive agents, and the like. The addition amount thereof is preferably from 0.25 to 20.0% by weight, more preferably from 0.5 to 15.0% by weight, and further preferably from 1.0 to 10.0% by weight, with respect to the solid content of the coating resin. Examples of the charge control agent include various types of charge control agents commonly used for toner, and various types of silane coupling agents. The kinds of the charge control agents and coupling agents usable are not particularly limited, and preferred are a charge control agent such as a nigrosine dye, a quaternary ammonium salt, an organic metal complex, or a metal-containing monoazo dye, an aminosilane coupling agent, a fluorine-based silane coupling agent, and the like. The addition amount of the charge control agent is preferably from 0.25 to 20.0% by weight, more preferably from 0.5 to 15.0% by weight, and further preferably from 1.0 to 10.0% by weight, with respect to the solid content of the coating resin.

The carrier may further contain a resin filled in the pores of the magnetic core material. The filling amount of the resin is desirably from 2 to 20 parts by weight, more desirably from 2.5 to 15 parts by weight, and even more desirably from 3 to 10 parts by weight, based on 100 parts by weight of the magnetic core material. By setting the filling amount of the resin to 2 parts by weight or more, the filling becomes sufficient and control of the charge amount by the resin coating becomes easy. On the other hand, by setting the filling amount of resin to 20 parts by weight or less, the occurrence of particle aggregation at the time of filling, which causes a change in the charge amount in long-term use, is suppressed.

The filling resin is not particularly limited and can be selected as appropriate depending on the toner to be combined, the environment of usage and the like. Examples thereof include a fluorine resin, an acrylic resin, an epoxy resin, a polyamide resin, a polyamide imide resin, a polyester resin, an unsaturated polyester resin, a urea resin, a melamine resin, an alkyd resin, a phenol resin, a fluoroacrylic resin, an acryl-styrene resin, a silicone resin, and a modified silicone resin modified with a resin such as an acrylic resin, a polyester resin, an epoxy resin, a polyamide resin, a polyamide imide resin, an alkyd resin, a urethane resin, or a fluorine resin, and the like. In consideration of elimination of the resin due to the mechanical stress during usage, a thermosetting resin is preferably used. Specific examples of the thermosetting resin includes an epoxy resin, a phenol resin, a silicone resin, an unsaturated polyester resin, a urea resin, a melamine resin, an alkyd resin, and resins containing them.

For the purpose of controlling the carrier characteristics, a conductive agent or a charge control agent may be added to the filling resin. The types and add amount of the conductive agent and charge control agent are the same as those in the coating resin. In the case where a thermosetting resin is used, an appropriate amount of a curing catalyst may be added as appropriate.

Examples of the catalyst include titanium diisopropoxy bis(ethyl acetoacetate), and the add amount thereof is preferably from 0.5% to 10.0% by weight, more preferably from 1.0% to 10.0% by weight, and even more preferably from 1.0% to 5.0% by weight, in terms of Ti atoms based on the solid content of the coating resin.

The apparent density (AD) of the carrier is preferably from 1.5 to 2.1 g/cm$^3$. By setting the apparent density to 1.5 g/cm$^3$ or more, excessive weight reduction of the carrier is suppressed and the charge imparting ability is further improved. On the other hand, by setting to 2.1 g/cm$^3$ or less, the effect of reducing the carrier weight can be made sufficient and the durability is further improved. The apparent density is more preferably from 1.7 to 2.1 g/cm$^3$, and even more preferably from 1.7 to 2.0 g/cm$^3$.

In addition, the environmental variation ratio (C/D) of the electric resistance of the carrier is preferably 1.25 or less, more preferably 1.23 or less, and even more preferably 1.20 or less. Here, the environmental variation ratio (C/D) of the electric resistance is calculated as a ratio of the logarithmic value (Log $R_{L/L}$) of electric resistance $R_{L/L}$ (unit: Ω) under the low temperature/low humidity (L/L) environment to the logarithmic value (Log $R_{H/H}$) of electric resistance $R_{H/H}$ (unit: Ω) under the high temperature/high humidity (H/H) environment.

$$C/D = \text{Log } R_{L/L} / \text{Log } R_{H/H} \quad \text{[Math. 3]}$$

By setting the environmental variation ratio (C/D) of the electric resistance to 1.25 or less, environmental dependence of the resistance of the carrier can be reduced, and suppression of image defects caused by a change in the use environment can sufficiently be achieved.

Methods for Producing Magnetic Core Material for Electrophotographic Developer and Carrier for Electrophotographic Developer In producing a carrier for electrophotographic developer of the present invention, first, a magnetic core material for electrophotographic developer is produced. For producing the magnetic core material, primary materials are weighed in appropriate amounts, and then pulverized and mixed by a ball mill, a vibration mill or the like for 0.5 hours or more, preferably from 1 to 20 hours. The raw materials are not particularly limited. The pulverized product thus obtained is pelletized by using a pressure molding machine or the like and then calcined at a temperature of from 700 to 1,200° C.

After the calcining, the resulting product is further pulverized with a ball mill, a vibration mill or the like, and then water is added thereto, and a fine-pulverization is carried out by using a bead mill or the like. Next, as necessary, a dispersant, binder or the like are added thereto, and after adjusting the viscosity, granulation is carried out by granulating in a spray dryer. When pulverizing after calcining, water may be added and pulverization may be carried out with a wet ball mill, a wet vibration mill or the like. The pulverizer such as the above-mentioned ball mill, vibration mill, and beads mill is not particularly limited, but in order to effectively and evenly disperse the raw materials, using fine beads having a particle size of 2 mm or less as the medium to be used is preferable. The degree of pulverization can be controlled by adjusting the particle size of the beads to be used, composition, and pulverizing time.

Next, the obtained granulated product is heated at 400 to 800° C. to remove organic components such as added dispersant and binder. If the sintering is performed with the dispersant and binder remaining, the oxygen concentration in the sintering apparatus tends to easily fluctuate due to decomposition and oxidation of the organic components, and the magnetic characteristics are greatly affected, and thus it becomes difficult to stably produce the magnetic core material. In addition, these organic components make it difficult to control the porosity of the magnetic core material, that is, they causes fluctuation in the crystal growth of ferrite.

Thereafter, the obtained granulated product is held at a temperature of from 800 to 1,500° C. for from 1 to 24 hours in an atmosphere in which oxygen concentration is controlled, to thereby carry out sintering. At that time, a rotary electric furnace, a batch electric furnace, a continuous electric furnace, or the like may be used, and oxygen concentration of the atmosphere during sintering may be controlled by introducing an inert gas such as nitrogen or a reducing gas such as hydrogen or carbon monoxide thereinto. Subsequently, the sintered product thus-obtained is disintegrated and classified. As the classification method, the existing method such as an air classification method, a mesh filtration method or a precipitation method is used to regulate the particle size to an intended particle size.

Thereafter, if desired, an oxide film treatment can be performed by applying low temperature heating to the surface, thereby regulating the electric resistance. The oxide film treatment can be performed by heat treatment, for example, at 300 to 700° C. by using a common rotary electric furnace, batch electric furnace or the like. The thickness of the oxide film formed by the treatment is preferably from 0.1 nm to 5 μm. In the case of 0.1 nm or more, the effect of the oxide film layer becomes sufficient. In the case of 5 μm or less, decrease in magnetization and impartment of excessively high resistance can be suppressed. Furthermore, as necessary, reduction may be carried out before the oxide film treatment. As such, porous ferrite particles (magnetic core material) having an average compression breaking strength of a certain level or more and a compression breaking strength variation coefficient of a certain level or less are prepared.

In order to make the average compression breaking strength of the magnetic core material a certain level or more and to make the compression breaking strength variation coefficient a certain level or less, it is desirable to precisely control the calcining condition, the pulverization condition, and the sintering condition. More specifically, the calcining temperature is preferably high. In the case where ferrite formation of the raw materials progresses at the calcining stage, the strain generated in the particle at the sintering stage can be reduced. As for the pulverization condition in the pulverization step after the calcining, long pulverization time is preferable. In the case where the particle diameter of the calcined product in the slurry (suspension containing the calcined product and water) is reduced, external stresses (mechanical stress such as collision, impact and friction between particles, and stress generated between particles) applied in the porous ferrite particles are evenly distributed. As for the sintering condition, long firing time is preferable. If the firing time is short, unevenness can be caused in the fired product, and variation of various physical properties including compression breaking strength is caused.

As the method for adjusting the anion amounts measured by the combustion ion chromatography, in a magnetic core material, various techniques can be mentioned. Examples thereof include using a raw material having small anion amounts, and performing washing operation in the stage of slurry before granulation. In addition, it is also effective to increase a flow rate of atmospheric gas introduced into a furnace at the time of calcination or sintering to make anions be easily discharged outside the system. In particular, the washing operation of slurry is preferably performed, and this can be performed, for example, by a technique in which after dehydration of the slurry, water is added again and wet pulverization is performed. In order to reduce the anion amounts, the dehydration and pulverization may be repeated.

The pore volume of the magnetic core material can be adjusted within the above range by controlling the firing temperature. For example, by increasing the temperature at the time of sintering, the pore volume tends to decrease. The pore volume tends to increase by lowering the temperature at the time of the sintering. In order to set the pore volume within the above range, the sintering temperature is preferably from 1,010° C. to 1,130° C., and more preferably from 1,050° C. to 1,120° C.

As described above, it is desired that after the production of the magnetic core material, the surface of the magnetic core material is coated with a resin to from a carrier. The coating resin used is that described above. As a coating method, a known method, for example, a brush coating method, a dry method, a spray dry system using a fluidized bed, a rotary dry system, or a dip-and-dry method using a universal agitator, can be employed. In order to improve the surface coverage, the method using a fluidized bed is preferred. In the case where the resin is baked after the coating, any of an external heating system and an internal heating system may be employed, and, for example, a fixed or fluidized electric furnace, a rotary electric furnace or a burner furnace can be used. Alternatively, the baking with a microwave may be used. In the case where a UV curable resin is used as the coating resin, a UV heater is employed. The temperature for baking is varied depending on the resin used, but it is desirable to be a temperature equal to or higher than the melting point or the glass transition point. For a thermosetting resin, condensation-crosslinking resin or the like, the temperature is desirably raised to a temperature at which the curing sufficiently progresses.

In producing the carrier of the present invention, as necessary, resin may be filled in the pores of the magnetic core material before the resin coating step. As the filling method, various methods can be used. Examples of the method include a dry method, a spray dry method using a fluidized bed, a rotary dry method, an immersion drying method using a universal stirrer, and the like. The resin used here is as described above.

In the step of filling the resin, it is preferable that the pores of the magnetic core material is filled with resin while mixing and stirring the magnetic core material and the filling resin under reduced pressure. By filling resin under reduced pressure as such, the pores can effectively filled with the resin. The degree of the decompression is preferably from 10 to 700 mmHg By setting to 700 mmHg or less, the effect of decompression can sufficiently be achieved. On the other hand, by setting to 10 mmHg or more, boiling of the resin solution during the filling step is suppressed, thereby allowing efficient filling. During the resin filling step, the filling can be accomplished by only one time of filling. However, depending on the type of resin, aggregation of particles may occur when attempting to fill a large amount of resin at a time. In such a case, by filling the resin separately in multiple times, filling can be realized without excess or deficiency while preventing aggregation.

After filling the resin, as necessary, heating is carried out by various methods to bring the filled resin into close contact with the core material. As the heating method, either an external heating method or an internal heating method may be used, and for example, a fixed or flow electric furnace, a rotary electric furnace, or a burner furnace can be used. Baking with microwave is also employable. Although the temperature varies depending on the resin to be filled, setting the temperature to equal to or higher than the melting point or glass transition point is desirable, and for a thermosetting resin, condensation-crosslinking resin or the like, the temperature is desirably raised to a temperature at which the curing sufficiently progresses.

Developer

The developer according to the present invention contains the carrier for electrophotographic developer described above and a toner. The particulate toner (toner particle) constituting the developer includes a pulverized toner particle produced by a pulverizing method and a polymerized toner particle produced by a polymerization method. The toner particle used in the present invention may be toner particles obtained by any method. The average particle diameter of the toner particles is in the range of preferably from 2 to 15 μm, and more preferably from 3 to 10 μm. By setting the average particle diameter to 2 μm or more, the charging ability is improved, and fogging and toner scattering are further suppressed. On the other hand, by setting to 15 μm or less, the image quality is further improved. The mixing ratio of the carrier and the toner, that is, the toner concentration is preferably set to 3 to 15% by weight. By setting the toner concentration to 3% by weight or more, a desired image density can be easily obtained. By setting to 15% by weight or less, toner scattering and fogging are further suppressed. On the other hand, in the case where the developer is used as a replenishment developer, the mixing ratio of the carrier and the toner may be from 2 to 50 parts by weight of the toner with respect to 1 part by weight of the carrier.

The developer according to the present invention prepared as described above can be used in a copying machine, a printer, a FAX machine, a printing machine, and the like, which use a digital system employing a development system in which an electrostatic latent image formed on a latent image holder having an organic photoconductive layer is reversely developed with a magnetic brush of a two-component developer containing a toner and a carrier while applying a bias electric field. Furthermore, the developer is also applicable to a full-color machine and the like using an alternative electric field, which is a method in which when applying a development bias from a magnetic brush to an electrostatic latent image side, an AC bias is superimposed on a DC bias.

EXAMPLE

The present invention will be described more specifically with reference to the examples below.

Example 1

(1) Preparation of Magnetic Core Material (Carrier Core Material)

The raw materials were weighed so as to be 38 mol % of MnO, 11 mol % of MgO, 50.3 mol % of $Fe_2O_3$, and 0.7 mol % of SrO, and pulverized and mixed for 4.5 hours with a dry media mill (vibration mill, ⅛ inch diameter stainless steel beads), and the obtained pulverized product was made into pellets of about 1 mm square by a roller compactor. Used were 17.2 kg of $Fe_2O_3$ as a raw material, 6.2 kg of trimanganese tetraoxide as an MnO raw material, 1.4 kg of magnesium hydroxide as an MgO raw material and 0.2 kg of strontium carbonate as an SrO raw material.

(1-1) Pulverization of Calcined Product

Coarse powder was removed from this pellet by using a vibration sieve with an opening of 3 mm, then fine powder was removed by using a vibration sieve with an opening of 0.5 mm and then, calcining was carried out by heating in a rotary electric furnace at 1,080° C. for 3 hours.

Next, after pulverizing to an average particle diameter of about 4 μm by using a dry media mill (vibration mill, ⅛ inch diameter stainless steel beads), water was added thereto, and further pulverization was carried out by using a wet media mill (horizontal bead mill, 1/16 inch diameter stainless steel beads) for 5 hours. The resulting slurry was squeezed and dehydrated by a belt press machine, water was added to the cake, and pulverization was carried out by using the wet media mill (horizontal bead mill, 1/16 inch diameter stainless steel beads) again for 5 hours to obtain Slurry 1. The particle size (volume average particle diameter of the pulverized material) of the particles in Slurry 1 was measured by Microtrack, and $D_{50}$ thereof was found 1.4 μm.

(1-2) Granulation

To Slurry 1 obtained was added PVA (aqueous 20% by weight solution) as a binder in an amount of 0.2% by weight based on the solid content, a polycarboxylic acid dispersant was added so as to attain a slurry viscosity of 2 poise, the granulation and drying were carried out by using a spray drier, and the particle size control of the obtained particles (granulated material) was performed by a gyro shifter. Thereafter, the granulated material was heated at 700° C. for 2 hours by a rotary electric furnace to remove organic components such as the dispersant and the binder.

(1-3) Sintering

Thereafter, the granulated material was held in a tunnel electric furnace at a firing temperature of 1,105° C. under an atmosphere with an oxygen gas concentration of 0.7% by volume for 5 hours to carry out sintering. At this time, the temperature rising rate was set to 150° C./h and the temperature falling rate was set to 110° C./h. Thereafter, the fired product was disintegrated with a hammer crusher, further classified with a gyro shifter and a turbo classifier to adjust the particle size, and subjected to magnetic separation to separate a low magnetic force product, thereby obtaining ferrite carrier core material (magnetic core material) formed of porous ferrite particles.

(2) Preparation of Carrier

To 20 parts by weight of a methyl silicone resin solution (4 parts by weight as a solid content because of its resin solution concentration being 20%) was added, as a catalyst, titanium diisopropoxy bis(ethyl acetoacetate) in an amount of 25% by weight based on the resin solid content (3% by weight in terms of Ti atom), and thereto was added 3-aminopropyltriethoxysilane as an aminosilane coupling agent in an amount of 5% by weight based on the resin solid content, to thereby obtain a filling resin solution.

This resin solution was mixed and stirred with 100 parts by weight of the porous ferrite particles obtained in (1-3) at 60° C. under reduced pressure of 6.7 kPa (about 50 mmHg), and while volatilizing toluene, the resin was allowed to penetrate and fill into voids (pores) of the porous ferrite particles. The inside of the vessel was returned to an ordinary pressure, and toluene was almost completely removed while stirring under the ordinary pressure. Thereafter, the porous ferrite particles were taken out from the filling apparatus, placed in a vessel, placed in a hot air heating oven, and subjected to a heat treatment at 220° C. for 1.5 hours.

Thereafter, the product was cooled to room temperature, ferrite particles with the resin cured were taken out, aggregation of the particles were removed with a vibrating sieve having an opening size of 200 mesh, and non-magnetic substances were removed by using a magnetic separator. Thereafter, coarse particles were again removed by the vibrating sieve having an opening size of 200 mesh, to obtain ferrite particles filled with resin.

Next, a solid acrylic resin (BR-73, produced by Mitsubishi Rayon Co., Ltd.) was prepared, 20 parts by weight of this acrylic resin was mixed with 80 parts by weight of toluene and the acrylic resin was dissolved in toluene, to prepare a resin solution. To this resin solution was further added carbon black (Mogul L, produced by Cabot Corporation) as a conductive agent in an amount of 3% by weight based on the acrylic resin, to prepare a coating resin solution.

Resin-filled ferrite particles obtained above were charged into a universal mixing agitator, the acrylic resin solution was added thereto, and resin coating was carried out by an immersion drying method. At this time, the acrylic resin was set to be 1% by weight based on the weight of the ferrite particles after filling the resin. After coating, heating was carried out at 145° C. for 2 hours, then aggregation of the particles was removed with a vibrating sieve having an opening size of 200 mesh, and the non-magnetic substances were removed by using a magnetic separator. Thereafter, coarse particles were again removed with the vibrating sieve having an opening size of 200 mesh, to thereby obtain a resin-filled ferrite carrier having a surface coated with a resin.

(3) Evaluation

As to the magnetic core material and carrier obtained, evaluations of various characteristics were made in the manner described below.

<Volume Average Particle Size>

The volume average particle size ($D_{50}$) of the magnetic core material was measured by using a micro-track particle size analyzer (Model 9320-X100, produced by Nikkiso Co., Ltd.). Water was used as a dispersion medium. First, 10 g of a sample and 80 ml of water were put into a 100-ml beaker and a few drops of a dispersant (sodium hexametaphosphate) was added thereto. Subsequently, the mixture was dispersed for 20 seconds by using an ultrasonic homogenizer (UH-150 Model, produced by SMT. Co., Ltd.) at an output power level set at 4. Thereafter, foams formed on a surface of the beaker were removed, and the sample was loaded in the analyzer to perform the measurement.

<Apparent Density>

The apparent densities (AD) of the magnetic core material and carrier were measured in accordance with JIS Z2504 (Test Method for Apparent Density of Metal Powders).

<Pore Volume>

The pore volume of the magnetic core material was measured by using mercury porosimeters (Pascal 140 and Pascal 240, produced by Thermo Fisher Scientific Inc.). A dilatometer CD3P (for powder) was used, and a sample was put in a commercially available gelatin capsule with a plurality of bored holes and the capsule was placed in the dilatometer. After deaeration in Pascal 140, mercury was charged, and a measurement in the low pressure region (0 to 400 kPa) was performed. Next, a measurement in the high pressure region (from 0.1 MPa to 200 MPa) was performed by Pascal 240. After the measurements, the pore volume of the ferrite particle was determined from data (the pressure and the mercury intrusion amount) for pore diameter of 3 μm or less converted from pressure. For determining the pore diameter, a control-cum-analysis software (PASCAL 140/240/440) associated with the porosimeter was used, and the calculation was carried out with the surface tension of mercury set at 480 dyn/cm and the contact angle set at 141.3°.

<BET Specific Surface Area>

The BET specific surface area of the magnetic core material was measured by using a BET specific surface area measuring apparatus (Macsorb HM model 1210, produced by Mauntec Corporation). A measurement sample was placed in a vacuum dryer, treated at 200° C. for 2 hours, held in the dryer until the temperature reached 80° C. or lower, and then taken out of the dryer. Thereafter, the sample was filled densely in a cell and set in the apparatus. The pretreatment was carried out at a degassing temperature of 200° C. for 60 minutes and then measurement was carried out.

<Ion Content>

The measurement of the contents of the anion components in the magnetic core material was performed by quantitative analysis under the following conditions by combustion ion chromatography.

Combustion equipment: Mg-2100H, produced by Mitsubishi Chemical Analytic Tech Co., Ltd.)
Sample amount: 50 mg
Combustion temperature: 1,100° C.
Combustion time: 10 minutes
Ar flow rate: 400 ml/min
$O_2$ flow rate: 200 ml/min
Humidified air flow rate: 100 ml/min
Absorption solution: Solution prepared by adding 1% by weight of hydrogen peroxide to the eluent described below
Analysis equipment: IC-2010, produced by Tosoh Corp.
Column: TSKgel SuperIC-Anion HS (4.6 mm I.D.×1 cm+4.6 mm I.D.×10 cm)
Eluent: Aqueous solution prepared by dissolving 3.8 mmol of $NaHCO_3$ and 3.0 mmol of $Na_2CO_3$ in 1 L of pure water
Flow rate: 1.5 mL/min
Column temperature: 40° C.
Injection volume: 30 μL
Measurement mode: Suppressor system
Detector: CM detector
Standard sample: Anion mixed standard solution produced by Kanto Chemical Co., Inc.

Meanwhile, the measurement of the contents of cation components in the magnetic core material was performed in the following manner. First, an acid solution was added to the ferrite particles and heated to completely dissolve the ferrite particles. Subsequently, quantitative analysis of the dissolved solution was performed by using an ICP emission spectrometer (ICPS-1000 IV, produced by Shimadzu Corporation), and the analysis result was converted into the contents in the ferrite particles.

<Electric Resistance>

The electric resistance characteristics of the magnetic core material and the carrier under the normal temperature and normal humidity (N/N) environment, under the high temperature and high humidity (H/H) environment and under the low temperature and low humidity (L/L) environment were respectively obtained as follows.

First, the electric resistance ($R_{N/N}$) of the magnetic core material under the N/N environment was measured as follows. That is, nonmagnetic parallel plate electrodes (10 mm×40 mm) were faced to each other with an interval between the electrodes of 2.0 mm, and 200 mg of the sample was weighed and filled into the gap. Next, the sample was held between the electrodes by attaching a magnet (surface magnetic flux density: 1,500 Gauss, area of the magnet in contact with the electrode: 10 mm×30 mm) to the parallel plate electrode, a voltage of 100V was applied, the electric resistance $R_{N/N}$ (unit: Ω) was measured with an insulation resistance meter (SM-8210, produced by DKK-TOA Corporation), and the logarithmic value (Log $R_{N/N}$) thereof was obtained. Here, the normal temperature and normal humidity refers to an environment at a room temperature of from 20 to 25° C. and a humidity of from 50 to 60%, and the above measurement was carried out after exposing the sample to the constant temperature and humidity chamber controlled to the above-described room temperature and humidity for 12 hours or more.

The electric resistance ($R_{H/H}$) of the magnetic core material under the H/H environment was measured as follows. That is, the sample was exposed for 12 hours or more in a chamber in which the chamber temperature and humidity were controlled such that the temperature was from 30 to 35° C. and the relative humidity was from 80 to 85% as the H/H environment, then the electric resistance $R_{H/H}$ (unit: Ω) was measured in the same manner as in the above-mentioned electric resistance under the normal temperature and normal humidity, and the logarithmic value (Log $R_{H/H}$) thereof was obtained. At this time, the interval between the electrodes was 2.0 mm and the applied voltage was 100V.

The electric resistance ($R_{L/L}$) of the magnetic core material under the L/L environment was measured as follows. That is, the sample was exposed for 12 hours or more in a chamber in which the chamber temperature and humidity were controlled such that the temperature was from 10 to 15° C. and the relative humidity was from 10 to 15% as the L/L environment, then the electric resistance $R_{L/L}$ (unit: Ω) was measured in the same manner as in the above-mentioned electric resistance under the normal temperature and normal humidity, and the logarithmic value (Log $R_{L/L}$) thereof was obtained. At this time, the interval between the electrodes was 2.0 mm and the applied voltage was 100V.

Then, by using the Log $R_{H/H}$ and Log $R_{L/L}$, the environmental variation ratio (A/B) of the electric resistance of the magnetic core material was obtained from the following formula.

$$A/B = \text{Log } R_{L/L} / \text{Log } R_{H/H} \quad \text{[Math. 4]}$$

Also, the electric resistances ($R_{N/N}$, $R_{H/H}$ and $R_{L/L}$) under the N/N environment, under the H/H environment and under the L/L environment of the carriers were measured in the same manner as in the magnetic core materials, and the environmental variation ratio (C/D) of the electric resistance of the carrier was obtained from the following formula.

$$C/D = \text{Log } R_{L/L} / \text{Log } R_{H/H} \quad \text{[Math. 5]}$$

<Compression Breaking Strength>

The average compression breaking strength ($CS_{ave}$) and the compression breaking strength variation coefficient ($CS_{var}$) of the magnetic core material were determined as follows. First, an ultra-small indentation hardness tester (ENT-1100a, produced by Elionix Co., Ltd.) was used, a sample dispersed on a glass plate was set in the tester and subjected to measurement of the compression breaking strength under an environment of 25° C. For the test, a flat indenter with a diameter of 50 μmϕ was used and loaded up to 490 mN at a load speed of 49 mN/s. As a particle to be used for the measurement, a particle which was singly present on the measurement screen (lateral 130 μm×length 100 μm) of the ultra-micro indentation hardness tester, had a spherical shape, and of which an average value of a major axis and a minor axis when measured by software attached to ENT-1100a was volume average particle diameter ±2 μm was selected. It was presumed that the particle had broken down when the slope of the load-displacement curve approached 0, and the load at the inflection point was taken as the compression breaking strength. The compression breaking strengths of 100 particles were measured and the compression breaking strengths of 80 pieces excluding those of 10 particles from each of the maximum value and the minimum value were employed as data to obtain the average compression breaking strength ($CS_{ave}$). Furthermore, the compression breaking strength variation coefficient ($CS_{var}$) was calculated from the following formula by calculating the standard deviation ($CS_{sd}$) for the 80 particles above.

$$CS_{var}(\%) = (CS_{sd}/CS_{ave}) \times 100 \quad \text{[Math. 6]}$$

Example 2

The preparation of magnetic core material and carrier and the evaluations were carried out in the same manner as in Example 1 except that the pulverization conditions of the calcined product were changed upon producing the magnetic core material. Here, the (1-1) pulverization of calcined product of Example 1 was changed as follows. That is, after pulverizing to an average particle diameter of about 4 μm by using a dry media mill (vibrating mill, ⅛ inch diameter stainless steel beads), water was added to the obtained product, and further pulverization was carried out by using a wet media mill (horizontal bead mill, 1/16 inch diameter stainless steel beads) for 5 hours. The resulting slurry was dehydrated by a screw pressmachine, water was added to the cake, and pulverization was carried out by using the wet media mill (horizontal bead mill, 1/16 inch diameter stainless steel beads) again for 5 hours to obtain Slurry 2. The particle size (volume average particle diameter of the pulverized material) of the particles contained in Slurry 2 was measured by Microtrack, and $D_{50}$ thereof was found 1.4 μm.

Example 3

The preparation of magnetic core material and carrier and the evaluations were carried out in the same manner as in Example 1 except that the pulverization conditions of the calcined product were changed upon producing the magnetic core material. Here, the (1-1) pulverization of calcined product of Example 1 was changed as follows. That is, after pulverizing to an average particle diameter of about 4 μm by using a dry media mill (vibrating mill, ⅛ inch diameter stainless steel beads), water was added to the obtained product, and further pulverization was carried out by using a wet media mill (horizontal bead mill, 1/16 inch diameter stainless steel beads) for 10 hours. Simultaneously with pulverization, the slurry during pulverization was subjected to concentration by cross flow filtration and addition of water, to thereby obtain Slurry 3. The particle size (volume average particle diameter of the pulverized material) of the particles contained in Slurry 3 was measured by Microtrack, and $D_{50}$ thereof was found 1.4 μm.

Example 4

The preparation of magnetic core material and carrier and the evaluations were performed in the same manner as in Example 1, except for using a raw material of a different lot in producing the magnetic core material.

Example 5 (Comparative Example)

The preparation of magnetic core material and carrier and the evaluations were carried out in the same manner as in Example 1 except that the pulverization conditions of the calcined product were changed upon producing the magnetic core material. Here, the (1-1) pulverization of calcined product of Example 1 was changed as follows. That is, after pulverizing to an average particle diameter of about 4 μm by using a dry media mill (vibrating mill, ⅛ inch diameter stainless steel beads), water was added to the obtained product, and further pulverization was carried out by using a wet media mill (horizontal bead mill, 1/16 inch diameter stainless steel beads) for 10 hours, to obtain Slurry 5. The particle size (volume average particle diameter of the pulverized material) of the particles contained in Slurry 5 was measured by Microtrack, and $D_{50}$ thereof was found 1.4 μm.

Example 6 (Comparative Example)

The preparation of magnetic core material and carrier and the evaluations were performed in the same manner as in Example 5, except for using a raw material of a different lot in producing the magnetic core material.

Example 7 (Comparative Example)

The preparation of magnetic core material and carrier and the evaluations were carried out in the same manner as in Example 1 except that the pulverization conditions of the calcined product were changed upon producing the magnetic core material. Here, the (1-1) pulverization of calcined product of Example 1 was changed as follows. That is, after pulverizing to an average particle diameter of about 4 μm by using a dry media mill (vibrating mill, ⅛ inch diameter stainless steel beads), water was added to the obtained product, and further pulverization was carried out by using a wet media mill (horizontal bead mill, 1/16 inch diameter stainless steel beads) for 4 hours. The resulting slurry was squeezed and dehydrated by a belt press machine, water was added to the cake, and pulverization was carried out by using the wet media mill (horizontal bead mill, 1/16 inch diameter stainless steel beads) again for 3 hours. The resulting slurry was squeezed and dehydrated by the belt press machine, water was added to the cake, and pulverization was carried out by using the wet media mill (horizontal bead mill, 1/16 inch diameter stainless steel beads) again for 4 hours, to obtain Slurry 7. The particle size (volume average particle diameter of the pulverized material) of the particles contained in Slurry 7 was measured by Microtrack, and $D_{50}$ thereof was found 1.4 μm.

Example 8 (Comparative Example)

The preparation of magnetic core material and carrier and the evaluations were carried out in the same manner as in Example 1 except that the firing temperature at the (1-3) sintering was changed to 1,145° C. in producing the magnetic core material and the amount of the methyl silicone resin solution in the filling resin solution was changed to 10 parts by weight (2 parts by weight as solid content) in producing the carrier.

Example 9 (Comparative Example)

The preparation of magnetic core material and carrier and the evaluations were carried out in the same manner as in Example 1 except that the firing temperature at the (1-3) sintering was changed to 1,010° C. in producing the magnetic core material and the amount of the methyl silicone resin solution in the filling resin solution was changed to 40 parts by weight (8 parts by weight as solid content) in producing the carrier.

Results

In Examples 1 to 9, the evaluation results obtained were as shown in Tables 1 and 2. In Examples 1 to 4, which are Inventive Examples, the environmental variation ratio (A/B) of the electric resistance was small, average compression breaking strength ($CS_{ave}$) was excellent, and the compression breaking strength variation coefficients ($CS_{var}$) was also small. On the other hand, in Examples 5 and 6, which are Comparative Examples, Expression (1) was excessively large, and as a result, the environmental variation ratio (A/B) of the electric resistance was large. On the other hand, in Example 7, Expression (1) was excessively small, and as a result, the compression breaking strength variation coefficient ($CS_{var}$) was large. Also, in Example 8, the pore volume was too small, and thus the apparent density (AD) of the carrier was high, indicating inferior weight reduction performance. On the other hand, in Example 9, the pore volume was too large, and thus inferior average compression breaking strength was exhibited. From these results, it has been found that according to the present invention, a magnetic core material for electrophotographic developer and a carrier for electrophotographic developer, which have a small change of the electric resistance caused by environmental differences and excellent strength with low specific gravity and with which a satisfactory image free of defects can be obtained, and a developer containing the carrier, can be provided.

TABLE 1

| | Magnetic core material | | | | | | | | | | | | | | | |
|---|---|---|---|---|---|---|---|---|---|---|---|---|---|---|---|---|
| | | | Pore | BET specific surface | Ion chromatography (ppm) | | | | | | | | ICP (%) | | | |
| | $D_{50}$ | AD | volume | area | $F^-$ | $Cl^-$ | $Br^-$ | $NO_2^-$ | $NO_3^-$ | $SO_4^{2-}$ | Expression | Expression | | | | |
| | (μm) | (g/cm³) | (mm³/g) | (m²/g) | (a) | (b) | (c) | (d) | (e) | (f) | (1) | (2) | $Li^+$ | $Na^+$ | $K^+$ | $Ca^{2+}$ |
| Ex. 1 | 40.1 | 1.92 | 48 | 0.37 | 1.1 | 14.7 | N.D. | 3.2 | 1.0 | 222 | 374.3 | 369.0 | <0.01 | 0.01 | <0.01 | 0.04 |
| Ex. 2 | 39.8 | 1.94 | 51 | 0.39 | 0.8 | 16.6 | N.D. | 3.0 | 0.8 | 389 | 559.6 | 555.0 | <0.01 | <0.01 | <0.01 | 0.03 |
| Ex. 3 | 40.3 | 1.92 | 51 | 0.40 | 1.4 | 20.3 | N.D. | 2.9 | 1.1 | 692 | 900.4 | 895.0 | <0.01 | 0.01 | <0.01 | 0.03 |
| Ex. 4 | 40.6 | 1.92 | 55 | 0.43 | 1.3 | 40.6 | N.D. | 2.5 | 1.0 | 189 | 599.8 | 595.0 | <0.01 | <0.01 | <0.01 | 0.04 |
| Ex. 5* | 40.1 | 1.91 | 54 | 0.43 | 0.9 | 29.4 | N.D. | 3.5 | 1.0 | 1123 | 1422.4 | 1417.0 | <0.01 | <0.01 | <0.01 | 0.05 |
| Ex. 6* | 40.4 | 1.93 | 49 | 0.38 | 1.0 | 15.5 | N.D. | 3.0 | 0.9 | 1606 | 1765.9 | 1761.0 | <0.01 | 0.01 | <0.01 | 0.05 |
| Ex. 7* | 39.9 | 1.95 | 46 | 0.35 | 1.3 | 10.8 | N.D. | 2.9 | 0.8 | 52 | 165.0 | 160.0 | <0.01 | <0.01 | <0.01 | 0.03 |
| Ex. 8* | 40.4 | 2.15 | 22 | 0.21 | 1.4 | 11.1 | N.D. | 3.4 | 1.1 | 206 | 322.9 | 317.0 | <0.01 | 0.02 | <0.01 | 0.04 |
| Ex. 9* | 40.2 | 1.61 | 107 | 0.73 | 0.9 | 15.8 | N.D. | 3.4 | 1.0 | 277 | 440.3 | 435.0 | <0.01 | 0.01 | <0.01 | 0.06 |

*indicates Comparative Example.

N.D. stands for "non-detected"

TABLE 2

| | Magnetic core material | | | | | | Carrier | | | | |
|---|---|---|---|---|---|---|---|---|---|---|---|
| | Electric resistance (Log Ω) | | | | Compression breaking strength | | Electric resistance (Log Ω) | | | | |
| | L/L (A) | N/N | H/H (B) | A/B | Average (mN) | Variation coefficient (%) | L/L (C) | N/N | H/H (D) | C/D | AD ($g/cm^3$) |
| Ex. 1 | 7.9 | 7.7 | 7.2 | 1.10 | 195 | 26 | 9.0 | 8.6 | 8.1 | 1.11 | 1.90 |
| Ex. 2 | 7.8 | 7.5 | 7.0 | 1.11 | 191 | 22 | 8.9 | 8.5 | 7.8 | 1.14 | 1.91 |
| Ex. 3 | 8.2 | 7.6 | 6.9 | 1.19 | 188 | 25 | 9.1 | 8.5 | 8.0 | 1.14 | 1.89 |
| Ex. 4 | 8.3 | 7.8 | 7.3 | 1.14 | 183 | 20 | 9.2 | 8.7 | 8.4 | 1.10 | 1.90 |
| Ex. 5* | 8.2 | 7.2 | 6.5 | 1.26 | 187 | 27 | 9.3 | 8.2 | 7.3 | 1.27 | 1.88 |
| Ex. 6* | 8.0 | 7.1 | 6.2 | 1.29 | 196 | 30 | 9.2 | 8.3 | 7.2 | 1.28 | 1.90 |
| Ex. 7* | 7.8 | 7.6 | 7.0 | 1.11 | 200 | 43 | 8.8 | 8.5 | 7.8 | 1.13 | 1.93 |
| Ex. 8* | 7.9 | 7.6 | 7.2 | 1.10 | 235 | 20 | 8.8 | 8.4 | 8.1 | 1.09 | 2.11 |
| Ex. 9* | 8.0 | 7.5 | 7.0 | 1.14 | 89 | 26 | 9.1 | 8.6 | 8.2 | 1.11 | 1.70 |

*indicates Comparative Example.

INDUSTRIAL APPLICABILITY

According to the present invention, a magnetic core material for electrophotographic developer, which has a small change of electric resistance caused by environmental variation and excellent strength while being low in specific gravity, and with which a satisfactory image can stably be obtained when being used for a carrier or a developer can be provided. Also, another object of the present invention can provide a carrier for electrophotographic developer and the developer including such a magnetic core material.

While the present invention has been described in detail with reference to specific embodiments, it will be apparent to those skilled in the art that various changes and modifications can be made without departing from the spirit and scope of the invention.

This application is based on Japanese Patent Application (No. 2017-023597) filed on Feb. 10, 2017, the contents of which are incorporated herein by reference.

The invention claimed is:

1. A magnetic core material for electrophotographic developer, satisfying a value of Expression (1): a+b x 10+c+d+e+f, being from 200 to 1,400, when an amount of fluorine ion is denoted by a (ppm), an amount of chlorine ion is denoted by b (ppm), an amount of bromide ion is denoted by c (ppm), an amount of nitrite ion is denoted by d (ppm), an amount of nitrate ion is denoted by e (ppm), and an amount of sulfate ion is denoted by f (ppm), which are measured by combustion ion chromatography; and having a pore volume of from 30 to 100 $mm^3/g$.

2. The magnetic core material for electrophotographic developer according to claim 1, wherein the magnetic core material has a ferrite composition comprising Fe, Mn, Mg.

3. The magnetic core material for electrophotographic developer according to claim 1, wherein the value of Expression (1) is from 250 to 1,200.

4. The magnetic core material for electrophotographic developer according to claim 1, wherein the pore volume of from 35 to 85 $mm^3/g$.

5. A carrier for electrophotographic developer comprising the magnetic core material for electrophotographic developer as described in claim 1 and a coating layer comprising a resin provided on a surface of the magnetic core material.

6. The carrier for electrophotographic developer according to claim 5, further comprising a resin filled in pores of the magnetic core material.

7. A developer comprising the carrier as described in claim 5 and a toner.

* * * * *